US006073676A

United States Patent [19]

Hairy et al.

[11] Patent Number: 6,073,676

[45] Date of Patent: Jun. 13, 2000

[54] PROCESS AND DEVICE FOR CONTROLLING COATING SUBSTANCE IN A DIE CASTER

[75] Inventors: Patrick Hairy, Velizy; Michel Richard, Paris, both of France

[73] Assignee: Centre Technique des Industries de la Fonderie, France

[21] Appl. No.: 08/875,566

[22] PCT Filed: Jan. 25, 1996

[86] PCT No.: PCT/FR96/00126

§ 371 Date: Jul. 25, 1997

§ 102(e) Date: Jul. 25, 1997

[87] PCT Pub. No.: WO96/22852

PCT Pub. Date: Aug. 1, 1996

[30] Foreign Application Priority Data

Jan. 26, 1995 [FR] France ..... 95 00876

[51] Int. Cl.[7] ..... B22D 17/22; B22D 17/32

[52] U.S. Cl. ..... 164/4.1; 164/72; 164/154.8; 164/267

[58] Field of Search ..... 164/4.1, 457, 72, 164/151, 154.8, 149, 267

[56] References Cited

U.S. PATENT DOCUMENTS 5,388,629 2/1995 Kami ..... 164/4.1

FOREIGN PATENT DOCUMENTS 60-221164 11/1985 Japan ..... 164/4.1
6-23508 2/1994 Japan ..... 164/151
1243893 7/1986 U.S.S.R. ..... 164/267

OTHER PUBLICATIONS

H. Tosa, et al., "Einflussgrossen auf die Druckguss–Auswerfung", Giesserei–Praxis, No. 5, Mar. 10, 1973, Berlin, Germany, pp. 79–84.

F. Klein, et al., "Ein integriertes Tribologiekonzept fur einen kostengunstigen und effektiven Druckgiessprozess", Giesserei, vol. 81, No. 21, Oct. 31, 1994, Dusseldorf, Germany, pp. 771–774.

Abstract of Japanese Patent Publication 60–124454 Published Jul. 3, 1985.

Abstract of U.S.S.R. inventor's certificate 1533830 Published Jan. 7, 1990.

*Primary Examiner*—J. Reed Batten, Jr.

*Attorney, Agent, or Firm*—Ostrolenk, Faber, Gerb & Soffen

[57] ABSTRACT

An installation has a fixed die portion and a moving die portion, ejector rods under the control of an actuator fed with control fluid, and a spray device for spraying a coating substance. A monitoring apparatus comprises a pressure sensor for continuously measuring the pressure of a control fluid, a device for measuring and recording the pressure as a function of time, a device for comparing the recorded measurement with a reference measurement, and a device for modifying the spraying of the coating substance as a function of the comparison.

5 Claims, 3 Drawing Sheets

PROCESS AND DEVICE FOR CONTROLLING COATING SUBSTANCE IN A DIE CASTER

BACKGROUND OF THE INVENTION

The present invention relates to a method and to apparatus for monitoring coating means in an installation for die-casting metals or metal alloys.

More precisely, in an installation for die-casting metals or metal alloys, the present invention relates to apparatus for monitoring, i.e. optimizing, the spreading of a coating liquid on the inside faces of the die used for performing the casting operation.

With reference initially to accompanying FIGS. 1*a* to 1*d*, an installation of known type is described for injection casting pieces made of metal alloy. The installation essentially comprises a die 12 made up of two portions, respectively a moving portion 14 and a fixed portion 16, with portions of the inside faces thereof respectively referenced 14*a* and 16*a* defining the cavity 18 of the die. When the die is closed, the alloy to be cast is placed in a container 20 and is injected under pressure into the cavity 18 by a system of pistons 22. This is shown in FIGS. 1*a* and 1*b*.

At the end of the casting operation, the moving portion 14 of the die is moved away. To enable the casting 24 to be extracted from the portion 14 of the die, extraction rods such as 26 are slidably mounted through the portion 14 of the die. These rods are operated simultaneously by an actuator that is not shown in the figures.

In addition, in order to avoid adhesion phenomena between the casting and the two portions 14 and 16 of the die, prior to closing the two portions of the die and injecting the metal alloy, a coating operation is performed by means of a coating device 28 which serves to spray the inside faces 14*a* and 16*a* with a coating liquid that forms a release film on said faces. The device can be stationary during the spray step or it may be moved back and forth. It carries a certain number of spray nozzles. As is well known, there exist various coating substances, in particular coating substances based on solvents or coating substances that can be diluted in water. These coating substances are themselves well known. It will be understood that the problem is to match the concentration of coating substance in the solvent, whether water or oil, with the quantity of substance that needs to be sprayed prior to each casting operation. It is of great importance to optimize the coating operation since it serves to reduce the force that needs to be exerted by the ejector 26 to expel the casting from the die. It will be understood that if excessive stress is applied, then the ejectors or the castings being ejected run the risk of being damaged, which constitutes one of the major obstacles to automating die-casting.

It will therefore be understood that it is very important to be able to monitor the effectiveness of the coating operation on a continuous basis and to be able to take action quickly as soon as the coating parameters are no longer satisfactory.

Another object of the invention is to provide monitoring apparatus that makes it possible automatically to modify the composition or flow rate of the coating substance as a function of the actual casting conditions.

Yet another object of the invention is to provide apparatus that can trigger an alarm if the conditions under which a casting is ejected move outside normal operating conditions.

SUMMARY OF THE INVENTION

To achieve this object, the invention provides apparatus for monitoring coating means in an installation for die-casting metals or metal alloys, said installation comprising a fixed die portion and a moving die portion together defining a die cavity, ejector means for ejecting the casting, the ejector means comprising ejector rods whose movements are controlled by an actuator fed with control liquid, and a spray device for spraying coating substance on the inside faces of the cavity-defining die portions, and means for feeding said strip with coating substances, the apparatus being characterized in that it comprises a single pressure sensor for continuously measuring the pressure of the control fluid in said actuator, means for recording said pressure as a function of time during the casting ejection cycle, and means for comparing said recorded curve with a reference curve including means for detecting a high pressure plateau (B) in the recorded curve and means for comparing the value of the pressure of said plateau with a minimum value (Pm) and with a maximum value (PM), and means for modifying said spraying of the coating substance as a function of the results of said comparison.

It will be understood that the principle of the invention is to detect the force an actuator needs to exert to proceed with the operation of ejecting the casting. The inventors have shown that the quality and the effectiveness of the coating operation are inversely proportional to the force which the ejection rods need to exert to eject the casting from the cavity of the die. It will be understood that by recording variations of pressure in this way, it is possible to act on the way the coating device is fed in order to optimize the effects of the coating.

In a preferred implementation, the monitoring apparatus further comprises means for comparing the measured pressure curve with a maximum pressure and means for triggering an alarm if the measured pressure exceeds the maximum pressure.

It will be understood that this makes it possible to operate the casting installation without continuous human surveillance, since the alarm system informs the person responsible for surveillance when operating conditions become unacceptable. Naturally, in a variant, the alarm signal can automatically cause the die-casting installation to be stopped.

Also preferably, the apparatus further comprises means for modifying the feed of coating substance to the spray device as a function of the comparison between the measured pressure curve and the reference curve.

In this improved embodiment, it will be understood that the coating parameters are adapted automatically as a function of the difference which exists between the measured curve of pressure in the ejector control actuator and the optimum pressure curve.

The invention also provides a method of monitoring the coating means, which method is characterized in that throughout the duration of an ejection cycle, the pressure of the ejector actuator control fluid is measured, said measurements are recorded, and the coating parameters are varied to optimize the measured curve of said pressure.

BRIEF DESCRIPTION OF THE DRAWINGS

Other characteristics and advantages of the present invention appear better on reading the following description of various embodiments of the invention given as non-limiting examples. The description refers to the accompanying figures, in which.

DESCRIPTION OF THE INVENTION

Figure 1A:
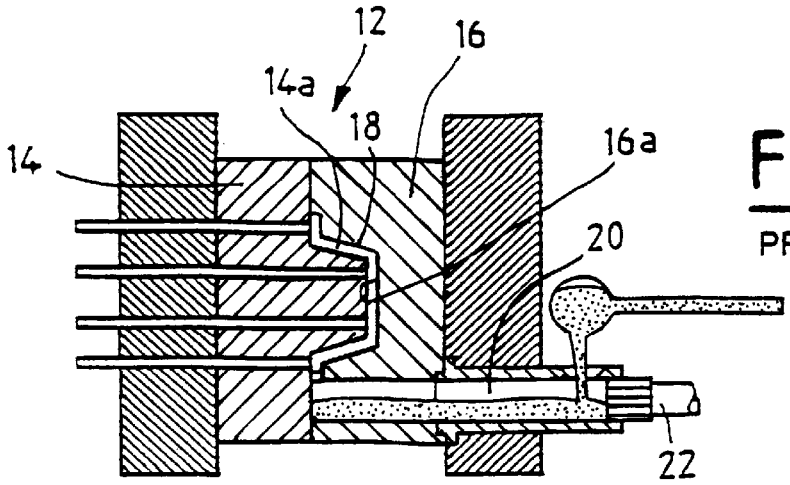
FIG. 1a PRIOR ART
FIGS. 1*a* to 1*d*, described above, illustrate a known type of die-casting installation.
Figure 1B:
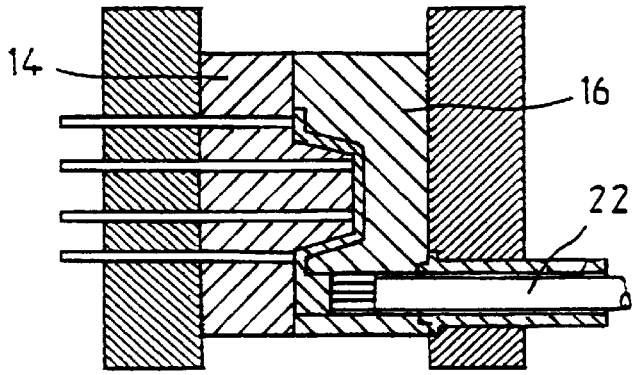
FIG. 1b PRIOR ART
Figure 1C:
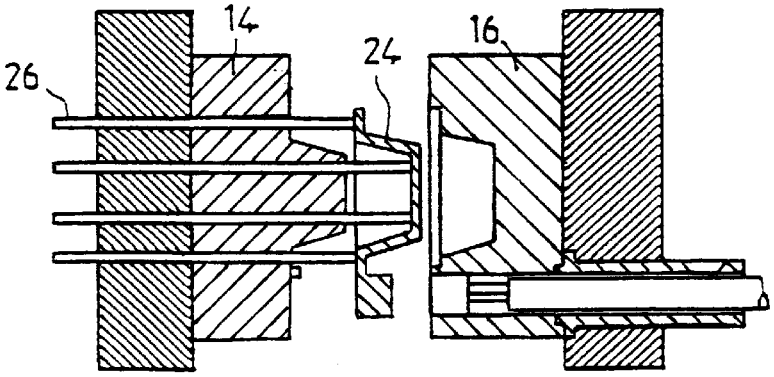
FIG. 1c PRIOR ART
Figure 1D:
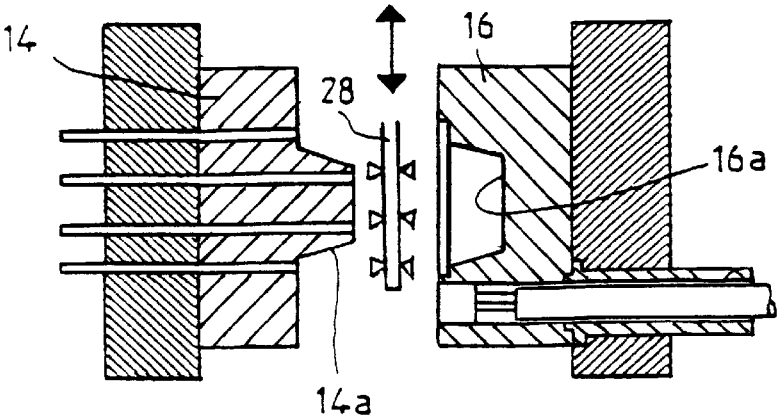
FIG. 1d PRIOR ART
Figure 2A:
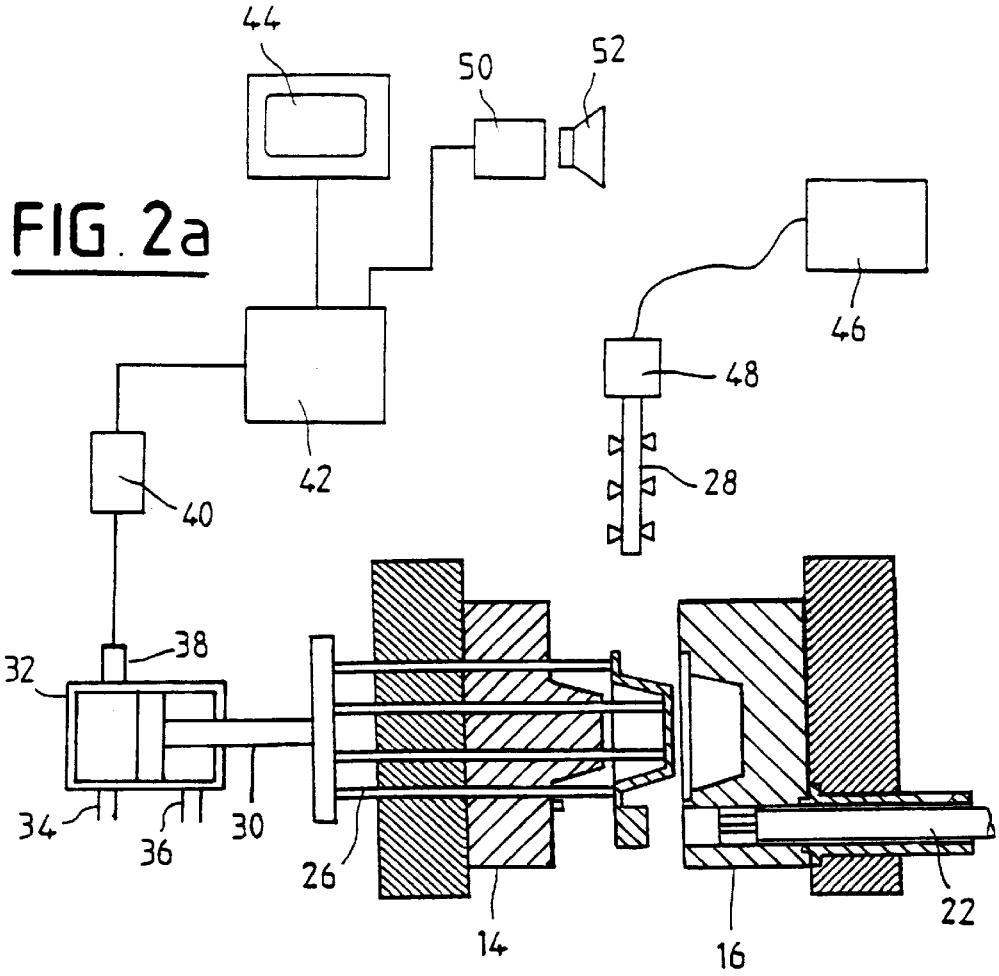
FIG. 2*a* shows a casting installation provided with apparatus constituting a first embodiment of the invention for monitoring the coating means.

With reference initially to FIG. 2*a*, a first embodiment of apparatus for monitoring the coating system is described. In this figure, there can be seen the two portions 14 and 16 of the die, together with a casting 24. There can also be seen the ejector rods 26 which are mechanically connected to the rod 30 of a control actuator 32. The actuator 32 is fed with control fluid via inlets 34 and 36. According to the invention, a pressure sensor 38 is permanently mounted on the actuator 32 for measuring the pressure that obtains within the control cylinder. The sensor 38 may be of any appropriate type and it delivers an analog signal which is optionally converted into digital data by a converter 40. A processor circuit 42 serves to record and store the various pressure values as a function of time throughout an ejection cycle. The corresponding curve can be displayed on a VDU such as 44. The processor circuit 42 also includes comparator means that are described below. FIG. 2*a* also shows the movable coating device 28 which is fed from a tank of coating liquid 46 via one or more control valves 48.

Figure 2B:
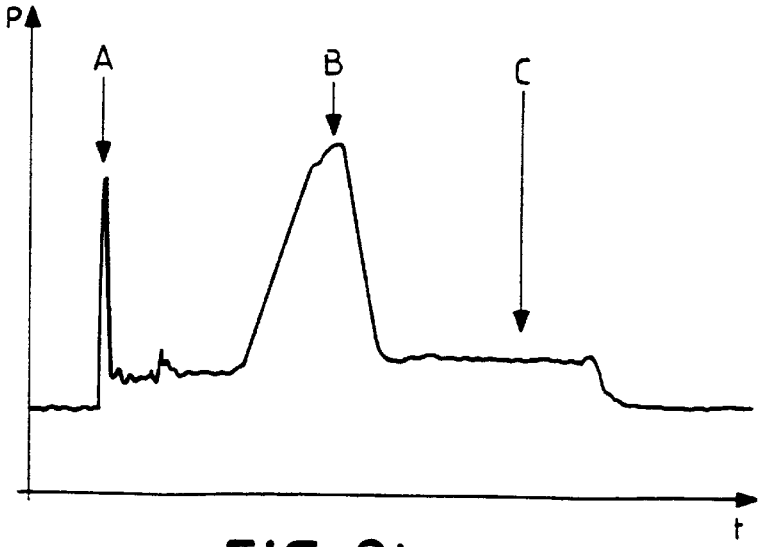
FIG. 2*b* shows one example of a curve of variation in the pressure of the control fluid in the ejector control actuator.

FIG. 2*b* shows the pressure P measured by the sensor 38 as a function of time t. The pressure curve has a first pressure peak A which corresponds to control oil reaching the actuator. This peak is not representative of ejection forces.

Thereafter there is a rise in pressure with a high plateau B which corresponds to the casting being ejected from the moving portion of the die under the effect of the ejector. The plateau B is of very short duration (30 milliseconds (ms) to 50 ms) and corresponds to rupturing of the coating film and of the microbonds between the inside face of the die and the casting. The curve also includes a third plateau C at constant pressure but of lower value which corresponds to the end of the ejection stroke. It has been discovered that the parameter which is the most meaningful and the most sensitive to variations in coating condition is the maximum pressure value in the plateau B. According to an important characteristic of the invention, it is thus the pressure value which corresponds to the plateau B which is retained and used as the sole meaningful parameter concerning the ejection force and which is therefore used to optimize coating conditions.

It should be recalled that there are numerous coating parameters. The effectiveness of the coating stage and in particular the quality of the film of lubricant deposited on the inside faces of the die is responsive to numerous parameters which vary from one run to another over a fairly wide range depending on the alloy under consideration and on the shape of the casting to be made. Amongst these parameters, the following may be mentioned:

- the temperature of the die (170° C. to 350° C.);
- the type of coating substance (ratio of wax over silicone, mineral or synthetic oil);
- the duration of spraying by means of the coating spray device (2 seconds (s) to 20 s);
- the concentration of pure substance (0.5% to 5%);
- the pressure of the air used for performing the spraying (3 bars to 6 bars);
- the pressure of the substance (3 bars to 6 bars);
- the spraying distance (100 mm to 400 mm);
- the flow rate of the substance through a spray nozzle (10 $cm^3/s$ to 30 $cm^3/s$);
- the number of nozzles (4 nozzles to 20 nozzles or even more); and
- the mode of spraying (strip stationary or moving back and forth).

In addition, numerous synergies exist between the various above-defined parameters that make a priori adjustments for optimizing the coating stage difficult to perform. In the prior art, the beginning of any new production run has therefore required a prior setting-up stage of greater or lesser duration during which some or all of the above-mentioned parameters have needed to be adjusted in order to obtain proper ejection. It will be understood that because of the monitoring apparatus, the various parameters can be optimized by performing various tests prior to starting production of the castings. For each parameter that is varied, the invention makes it possible to determine an optimum value of the parameter by selecting the value of the parameter that is determined as corresponding to the lowest possible pressure P for the plateau B.

During this preliminary stage, it is therefore possible to use the apparatus to adjust the various parameters which thus correspond to an optimum pressure curve or more precisely to a maximum value for the plateau pressure B that is as low as possible.

During normal operation of the die, the monitoring apparatus thus makes it possible on each operation to verify whether the value of the maximum pressure is increasing relative to a previously-defined optimum value. Under such circumstances, it becomes necessary to modify the coating parameters, as mentioned above.

Also, in a preferred implementation of the invention, the processor device may continuously compare the maximum pressure corresponding to the plateau B with a minimum acceptable pressure value Pm and with a maximum acceptable pressure value PM. If the measured value for the maximum pressure moves outside the pressure range Pm to PM, then the processor circuit 42 triggers an alarm circuit 50 which serves to display a visible alarm on the VDU 44 or to generate an audible alarm 52. It will be understood that in this embodiment, the monitoring apparatus also makes it possible to provide surveillance over effective operation of the system for ejecting from the die.

Figure 3:
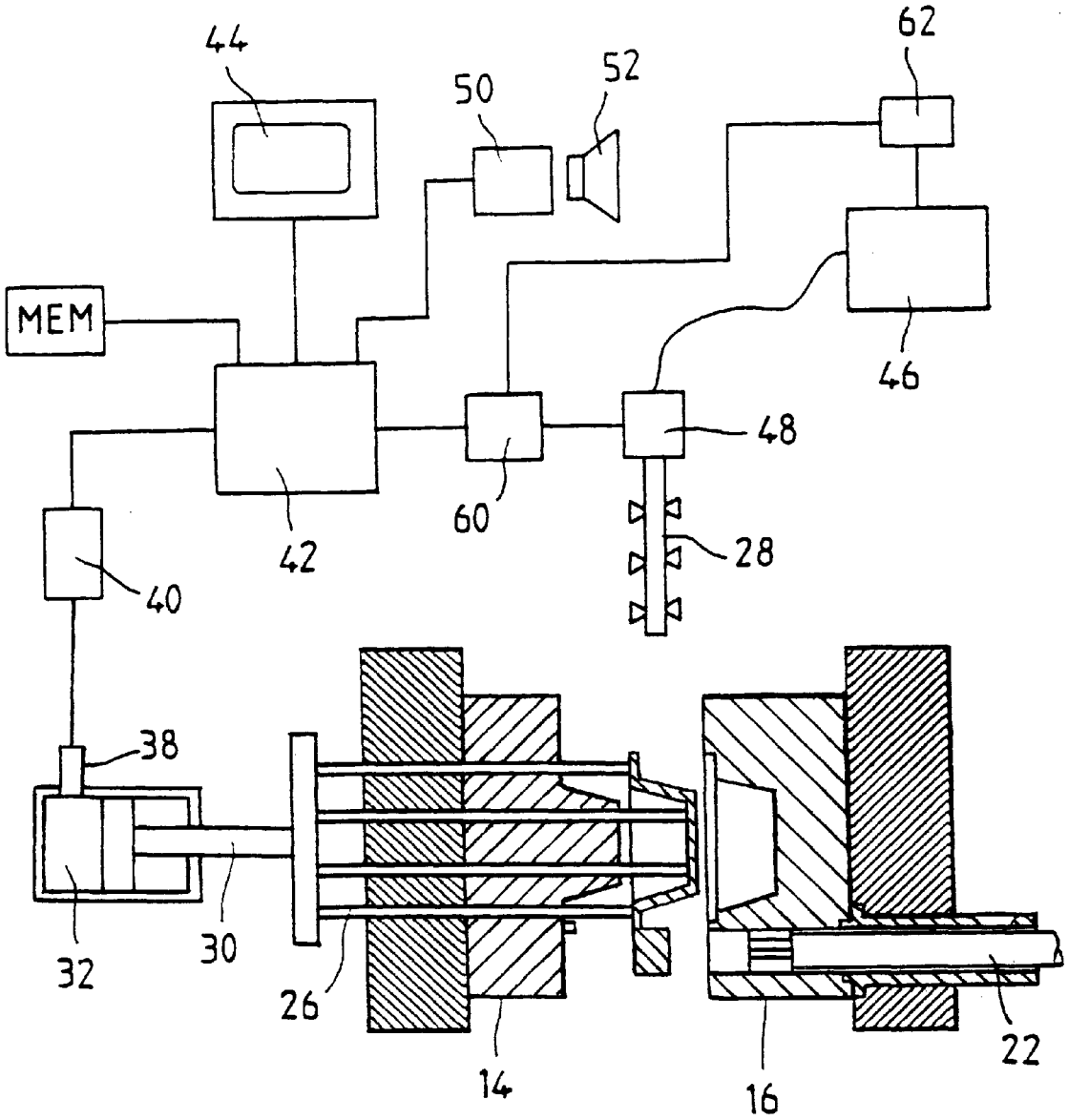
FIG. 3 shows a second embodiment of the monitoring apparatus enabling the coating parameters to be adapted automatically.

Reference is now made to FIG. 3 while describing a second embodiment of the monitoring apparatus in which a servo-control system is provided for adjusting the parameters of the coating liquid as a function of the information given by the pressure sensor. In this embodiment, the processor circuit 42 includes means for comparing the maximum pressure of the control liquid that corresponds to the plateau B with a reference value. If a difference exceeding a predetermined value is detected, then the processor circuit 42 activates a control circuit 60 which enables various parameters governing the spraying of the coating liquid to be modified. For example, the control circuit 60 controls the valve 48 for adjusting feed to the coating spray device 28 and, for example, a feed duct 62 for feeding solvent into the coating substance receptacle 46. By automatically controlling changes to the flow rate of the coating liquid in this way and also controlling spraying duration and the content of concentrated coating substance in the solvent, it is possible to modify automatically the parameters so as to return to optimum coating conditions without any manual intervention being necessary. The coating stage is thus servo-controlled.

I claim:

1. In an installation for producing castings by die-casting metals or metal alloys comprising a fixed die portion and a moving die portion together defining a die cavity, an ejector for ejecting a casting, the ejector comprising ejector rods whose movements are controlled by an actuator fed with control liquid, and a spray device for spraying a coating substance on the inside faces of the cavity-defining die portions, and means for feeding said device with the coating substance, an apparatus comprising a single pressure sensor for continuously measuring the pressure of the control liquid in said actuator, means for recording a measurement of said pressure as a function of time during a casting ejection cycle, means for recording a curve representative of the recorded pressure as a function of time, means for providing a reference curve, and means for comparing said recorded measurement with a reference measurement including means for detecting a high pressure plateau (B) in the recorded measurement and means for comparing the value of the pressure of said plateau with a minimum value (Pm) and with a maximum value (PM), and means for modifying said spraying of the coating substance as a function of the results of said comparison.

2. An installation according to claim 1, having means responsive to said comparison to trigger an alarm if the measured pressure does not lie between the values (Pm) and (PM).

3. An installation according to claim 1, having means for modifying the feed of coating substance to the spray device as a function of the comparison between the recorded pressure curve and the reference pressure curve.

4. An installation according to claim 2, having means for modifying the feed of coating substance to the spray device as a function of the comparison between the pressure measurement and the reference pressure measurement.

5. A method of controlling coating substance in the installation of claim 1, the method comprising continuously measuring the pressure of the control liquid in said actuator, recording a measurement of said pressure as a function of time during a casting ejection cycle, recording a curve representative of the recorded pressure as a function of time, providing a reference curve, comparing said recorded measurement with a reference measurement including detecting a pressure plateau in the recorded measurement and comparing the value of the pressure of said plateau with a minimum value and with a maximum value, and modifying said spraying of the coating substance as a function of the results of said comparison.

* * * * *